US011840373B2

(12) United States Patent
Gibson

(10) Patent No.: US 11,840,373 B2
(45) **Date of Patent: *Dec. 12, 2023**

(54) APPARATUS FOR SECURING BOXES ON A PALLET

(71) Applicant: Cole Gibson, Rosemead, CA (US)

(72) Inventor: Cole Gibson, Rosemead, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/806,798

(22) Filed: Jun. 14, 2022

(65) Prior Publication Data

US 2022/0306340 A1 Sep. 29, 2022

Related U.S. Application Data

(63) Continuation-in-part of application No. 17/103,008, filed on Nov. 24, 2020, now Pat. No. 11,390,423.

(51) Int. Cl.
*B65D 19/44* (2006.01)
*B65D 71/00* (2006.01)

(52) U.S. Cl.
CPC ..... *B65D 19/44* (2013.01); *B65D 71/0096* (2013.01); *B65D 2519/00815* (2013.01)

(58) Field of Classification Search
CPC .... B65D 19/44; B65D 19/38; B65D 71/0096; B65D 2519/00815
See application file for complete search history.

(56) References Cited

U.S. PATENT DOCUMENTS

| | | | | | |
|---|---|---|---|---|---|
| 2,926,793 | A * | 3/1960 | Sparks | B65D 19/385 | 108/53.5 |
| 2,953,340 | A * | 9/1960 | Skubic | B65D 19/385 | 108/53.5 |
| 3,285,204 | A * | 11/1966 | Schweitzer, Jr. | B65D 19/385 | 108/55.3 |
| 4,046,347 | A * | 9/1977 | Bryan | B65D 19/38 | 248/346.02 |
| 11,390,423 | B2 * | 7/2022 | Gibson | B65D 59/00 | |
| 2011/0220544 | A1 * | 9/2011 | De Alba | B65D 19/385 | 220/4.28 |
| 2016/0050207 | A1 * | 2/2016 | Valine | H04L 63/10 | 726/3 |

* cited by examiner

*Primary Examiner* — Daniel J Rohrhoff
(74) *Attorney, Agent, or Firm* — Kilpatrick Townsend & Stockton LLP

(57) ABSTRACT

In at least one embodiment, an apparatus for securing boxes on a pallet may a structural member sized to run a length or a width of a pallet, the structural member having a top side and a bottom side. The structural member may be L-shaped. The structural member allows for securing a load on the pallet. The structural member also provides additional surface area for plastic wrap to secure a load. The structural member may have tabs that fit within the recesses between planks of a pallet. In various embodiments, the structural member and tabs may be formed as a single composite structure.

20 Claims, 17 Drawing Sheets

APPARATUS FOR SECURING BOXES ON A PALLET

CROSS-REFERENCES TO RELATED APPLICATIONS

This application is a Continuation-in-Part of U.S. application Ser. No. 17/103,008 entitled "Apparatus for Securing Boxes on a Pallet," filed on Nov. 24, 2020, hereby incorporated by reference in its entirety and for all purposes.

BACKGROUND

Much of the world's goods are transported in cardboard boxes. The cardboard boxes can be stacked onto pallets and loaded into trailers. If left unsecured, the motion of the trailer during transit can cause the boxes to fall off the stack resulting in broken and damaged merchandize. Such damages can result in significant losses, especially for items such as sterilized medical products that can be come compromised when the boxes are damaged.

To counter the shifting of boxes in the stack, plastic wrap has been used to secure the boxes together. While the plastic wrap may bind some of the boxes together, the combined group of boxes may shift on the pallet and may damage boxes due the weight of the combined boxes on certain boxes resulting in damage to merchandize. This shifting can be due to the fact that the surface area of the pallet is small compared with the total surface area of the shrink-wrap that comes in contact with the boxes. In addition, it is difficult to put the boxes back on the pallet after they have shifted with the shrink-wrap on.

Other techniques to counter movement of boxes during shipping can involve banding placed around the boxes. In addition to the banding, corner protectors can be used to reduce the possibility of damaging the boxes. Banding increases the costs for shipments due to increased materials costs and more importantly time costs in securing the banding around the boxes. In addition, the tension placed on the banding can damage the boxes if the tension is not properly applied.

It would be advantageous for use of an apparatus, with and without the plastic wrap that keeps the boxes from shifting during transit.

SUMMARY

According to some implementations, an apparatus may include an L-shaped structural member sized to run a length of a pallet, the L-shaped structural member having a top side and a bottom side.

According to some implementations, a system may include a first L-shaped structural member sized to fit the long side of the pallet; a second L-shaped structural member sized to fit the short side of the pallet; and a plurality of tabs affixed to a bottom side of at least one of the first L-shaped structural member and the second L-shaped structural member, wherein the plurality of tabs are affixed at positions to fit within gaps between deck boards of the pallet.

According to some implementations, a system securing a plurality of boxes on a pallet having a long side and a short side, the system may include a first L-shaped structural member sized to fit the short side of the pallet; and a second L-shaped structural member sized to fit the short side of the pallet, wherein the first L-shaped structural member and the second L-shaped structural member are affixed to form a T-shaped component that fits alongside an end of a deck board of the pallet.

These and other embodiments of the disclosure are described in detail below.

A better understanding of the nature and advantages of embodiments of the present disclosure may be gained with reference to the following detailed description and the accompanying drawings.

Like reference, symbols in the various drawings indicate like elements, in accordance with certain example implementations. In addition, multiple instances of an element may be indicated by following a first number for the element with a letter or a hyphen and a second number. For example, multiple instances of an element 110 may be indicated as 110-1, 110-2, 110-3 etc., or as 110*a*, 110*b*, 110*c*, etc. When referring to such an element using only the first number, any instance of the element is to be understood (e.g., element 110 in the previous example would refer to elements 110-1, 110-2, and 110-3 or to elements 110*a*, 110*b*, and 110*c*).

DETAILED DESCRIPTION

The following detailed description of example implementations refers to the accompanying drawings. The same reference numbers in different drawings may identify the same or similar elements.

Figure 1:
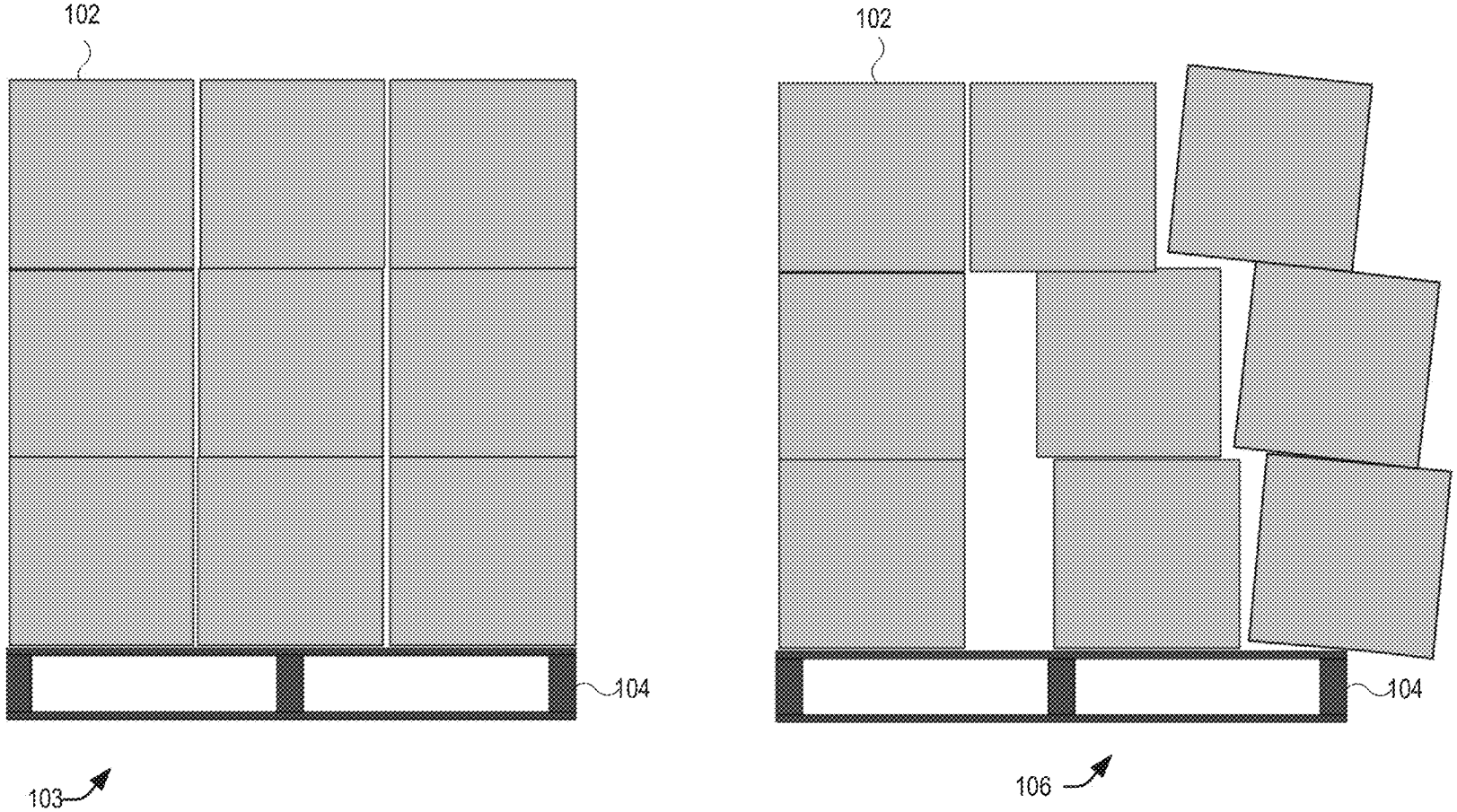
FIG. 1 illustrates an exemplary load of boxes loaded on a pallet.

FIG. 1 illustrates an exemplary load of boxes 102 loaded on a pallet 104. Commercial goods can be packaged in boxes for shipping. Commercial goods can be shipped from manufacturing locations to retailers or to end customer customers in boxes 102 (e.g., cardboard boxes). In a first stack 103, the boxes 102 can be stacked together on a pallet 104. Standard pallet size can be 40 inches by 48 inches with each deck board being 3½ inches wide 5/16 of an inch thick. The pallet 104 can be constructed from cardboard, wood, plastic resin and other materials. The pallets 104 can be loaded into trailers in two rows into a standard trailer which is generally 102 inches wide. The pallets 104 can be loaded against each longitudinal side of the trailer to provide support for one side of the load of boxes 102 on the pallets 104. This loading configuration would leave a gap between each row of pallets 104. As the trailer travels and turns, the centripetal force can cause the boxes 102 to fall, as shown in second stack 106, resulting in damage to the goods.

Figure 2:
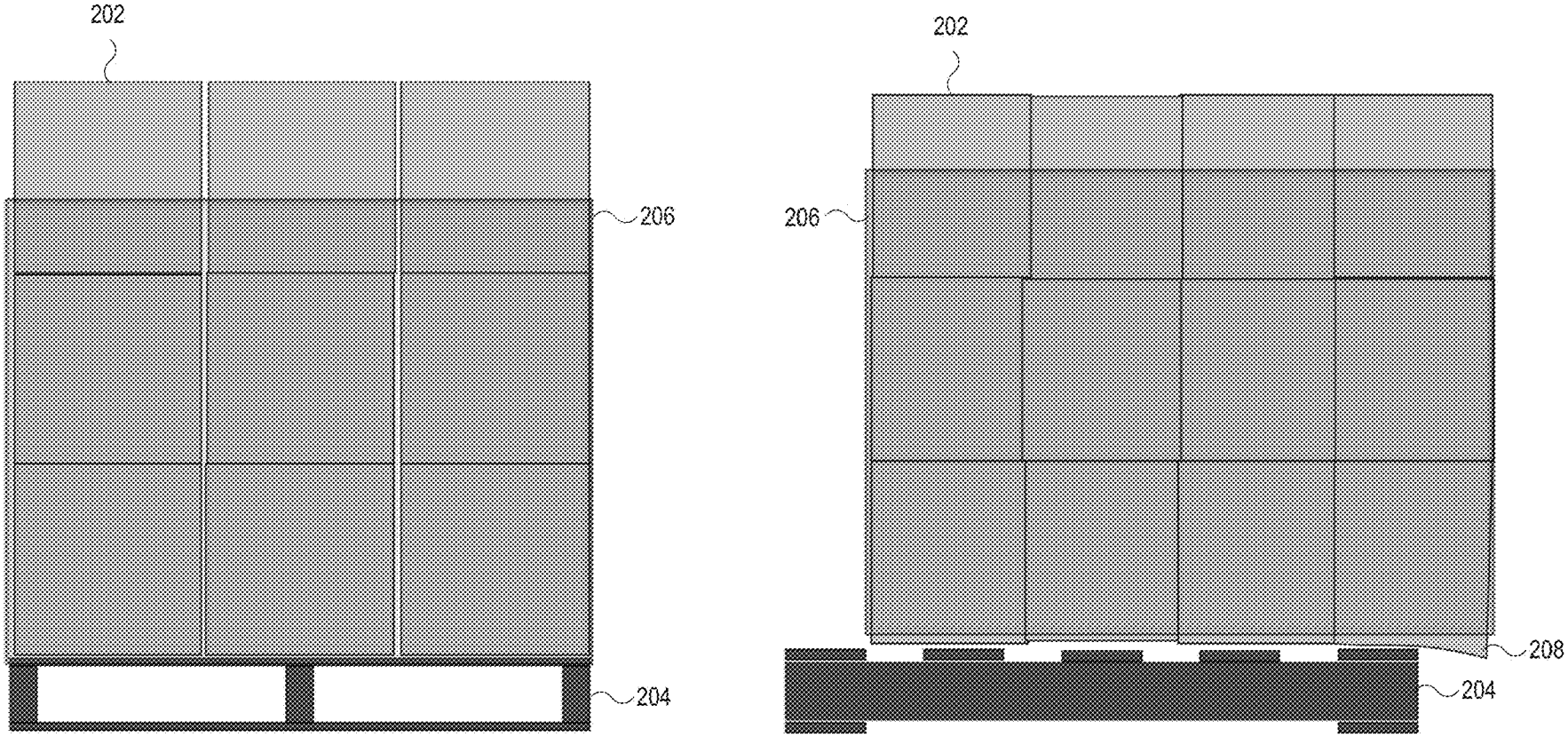
FIG. 2 illustrates an exemplary load of boxes loaded on a pallet and secured with plastic wrap.

FIG. 2 illustrates an exemplary load of boxes 202 loaded on a pallet 204 where the boxed are secured using plastic wrap 206. One or more layers of plastic can be wrapped around the boxes 202 on the pallet 204. The plastic wrap 206 can secure the individual boxes 202 to each other. However, the surface area of the pallet 204 that the shrink-wrap contacts may not be sufficient to secure the weight of the load to the pallet 204. As a result, as the load of boxes 202 can shift with respect to the pallet 204. The weight of the load of boxes can disproportionately apply to a side or corner of the pallet 204 resulting in damage 208 to the boxes 202. Also, these configurations can result in increased labor in putting the stack of boxes back on the pallet if moved.

Figure 3:
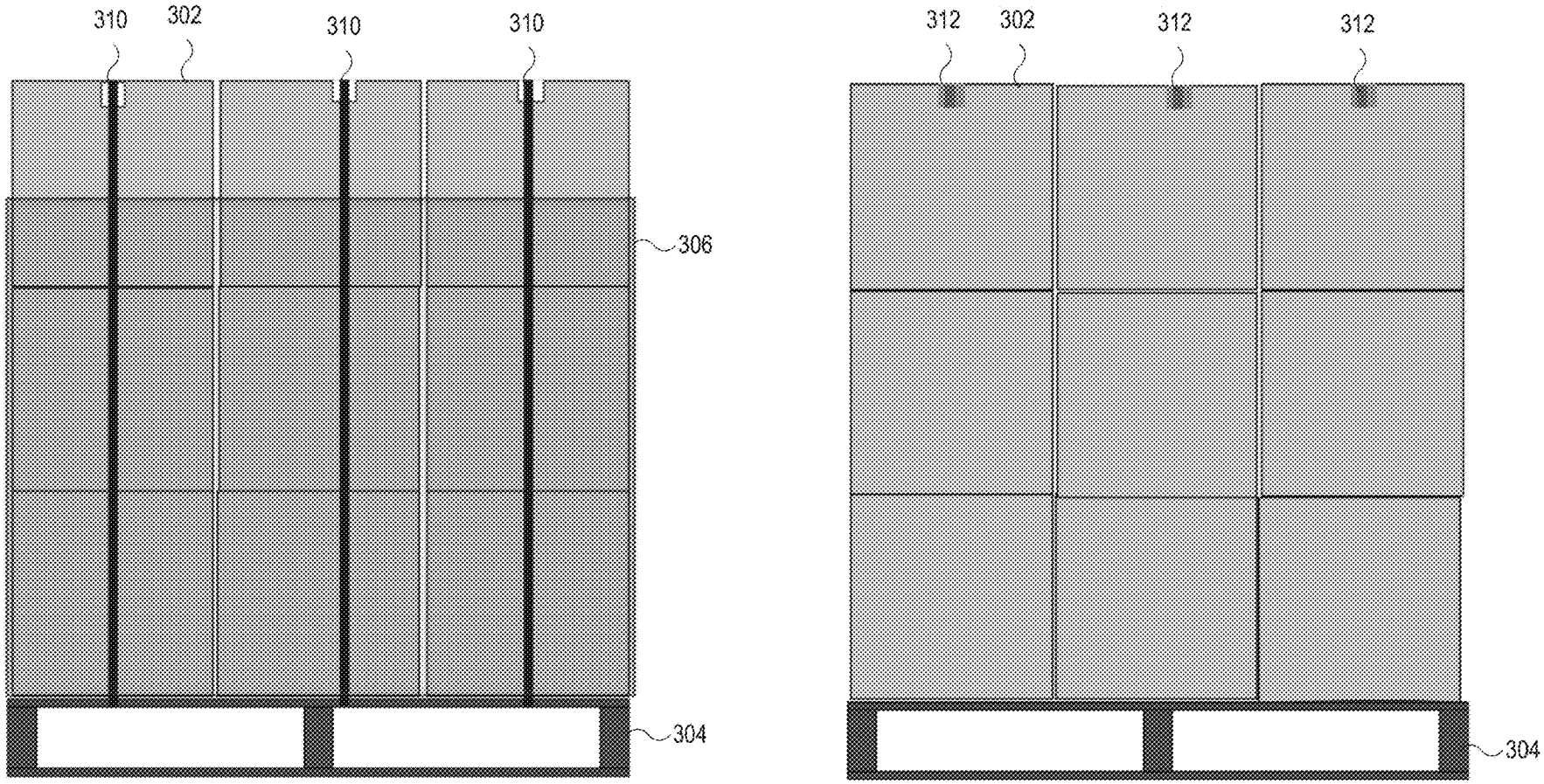
FIG. 3 illustrates an exemplary load of boxes loaded on a pallet and secured with plastic wrap and banding.

FIG. 3 illustrates an exemplary load of boxes 302 loaded on a pallet 304 and secured with plastic wrap 306 and banding 310. The banding 310 can be used to secure the boxes to the pallets 304. Corner protectors 312 can also be used in conjunction with the banding 310. In addition to the extra expense of the banding 310 and corner protectors 312, it can be time consuming to properly install the banding for each load. Further, the tension of the banding tool (not shown) can still damage the boxes 302 during the banding process.

Figure 4:
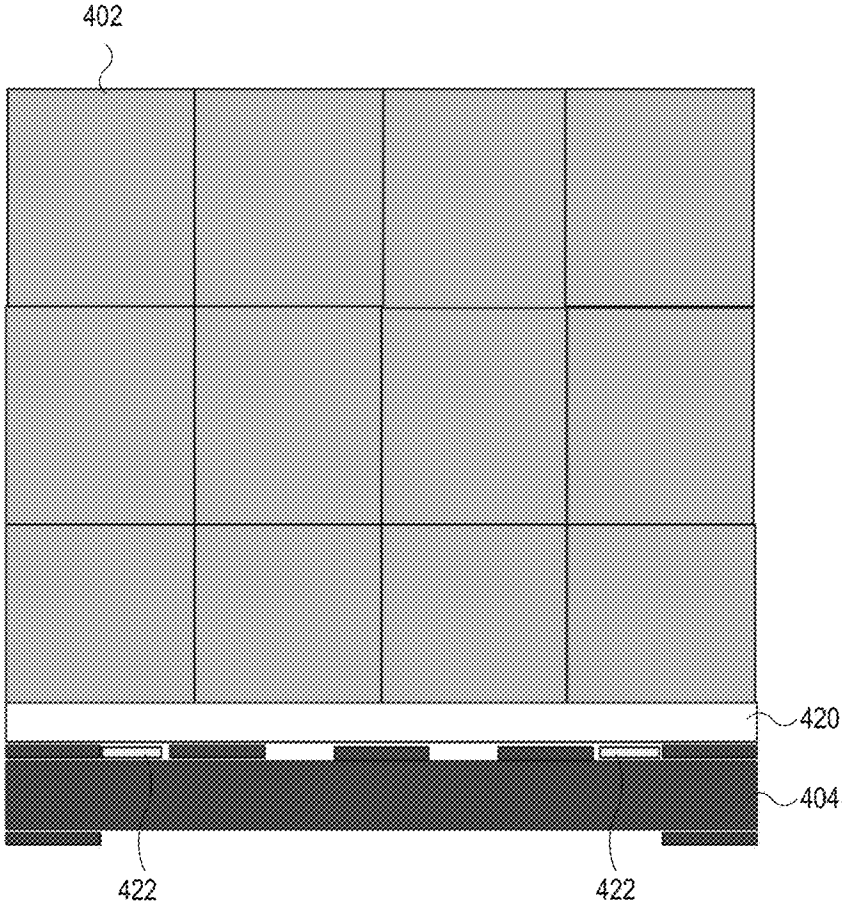
FIG. 4 illustrates an exemplary load of boxes loaded on a pallet using an exemplary apparatus for securing the load.
Figure 4:
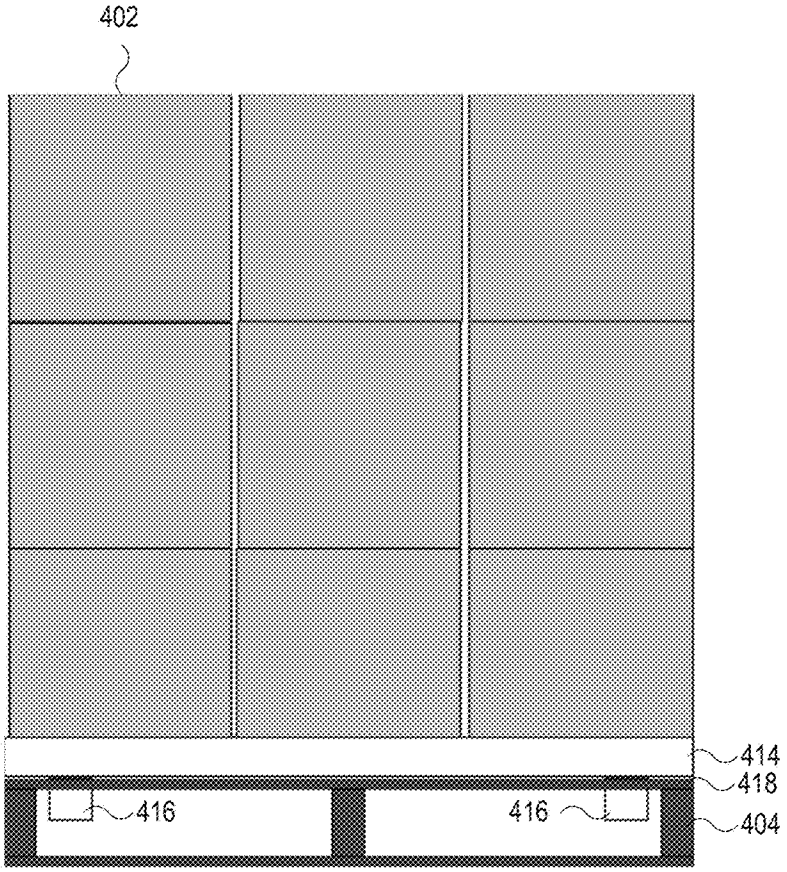

FIG. 4 illustrates an exemplary load of boxes 402 loaded on a pallet 404 using an apparatus 414, 420 for securing the load of boxes 402. In various embodiments, an apparatus 414, 420 can include an L-shaped structural member sized to run a length of a side of a pallet 404. The L-shaped structural member can include a top side and a bottom side. A plurality of tabs 416 can be affixed to the bottom side of the L-shaped structural member, wherein the plurality of tabs 416 are affixed at a position along a length of the L-shaped structural member to fit within gaps between deck boards of the pallet 404.

The apparatus 414, 420 can be manufactured in a plurality of lengths. In a first embodiment, the apparatus 414 can be sized to fit the length of a short side of the pallet 404. In some embodiments, the short side of the pallet 404 is 40 inches in length. Other lengths can be used. The upper portion of the L-shaped structural member can be placed against the edge of a pallet 404. The lower portion of the L-shaped structural member sits on the deck of the pallet 404. Boxes 402 can be placed to sit on the lower portion of the L-shaped structural member. The tabs 416 can fit into gaps between the planks 418 of the pallet 404. In this way, the tabs 416 can secure the L-shaped structural member in place longitudinally on the pallet 404. In various embodiments, the apparatus 414 and the tabs 416 are formed as a single composite piece. The composite piece can be made from various materials such as cardboard, plastic, fiberglass, carbon fiber, metals, wood, etc.

In a second embodiment, the apparatus 420 can be sized to fit the length of the long side of the pallet 404. In some embodiments, the long side of the pallet 404 is 48 inches in length. Other lengths can be used. The upper portion of the L-shaped structural member can be placed against the edge of a pallet 404. The lower portion of the L-shaped structural member sits on the deck of the pallet 404. Boxes 402 can be placed to sit on the lower portion of the L-shaped structural member. The tabs 416 can fit into gaps between the planks of the pallet 404. In this way, the tabs 422 can secure the L-shaped structural member in place longitudinally and laterally on the pallet 404. In various embodiments, the apparatus 420 and the tabs 422 are formed as a single composite piece. The composite piece can be made from various materials such as cardboard, plastic, fiberglass, carbon fiber, metals, wood, etc.

Figure 5:
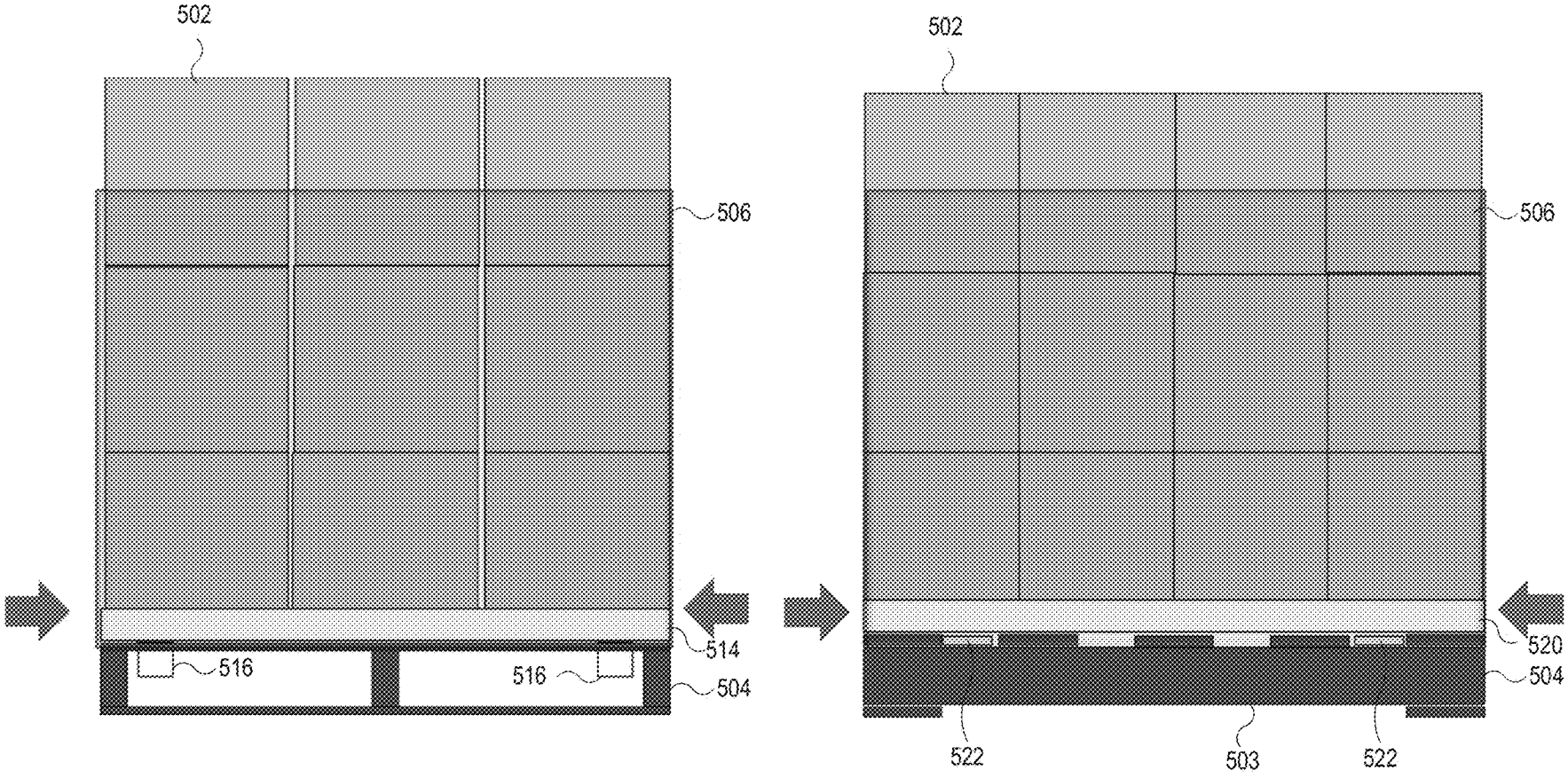
FIG. 5 illustrates an exemplary load of boxes loaded on a pallet using an exemplary apparatus and plastic wrap to secure loads on a pallet.

FIG. 5 illustrates an exemplary load of boxes 502 loaded on a pallet 504 using an exemplary apparatus 514, 520 and plastic wrap 506 to secure loads on a pallet 504. In various embodiments, an apparatus 514, 520 can include an L-shaped structural member sized to run a length of a side of a pallet 504. The L-shaped structural member can include a top side and a bottom side. A plurality of tabs 516 can be affixed to the bottom side of the L-shaped structural member, wherein the plurality of tabs 516 are affixed at a position along a length of the L-shaped structural member to fit within gaps between deck boards of the pallet 504. In various embodiments, the apparatus 514, 520 and the tabs 516 are formed as a single composite piece. The composite piece can be made from various materials such as cardboard, plastic, fiberglass, carbon fiber, metals, wood, etc.

The apparatus 514, 520 can be manufactured in a plurality of lengths. In a first embodiment, the apparatus 514 can be sized to fit the length of a short side of the pallet 504. In some embodiments, the short side of the pallet 504 is 40 inches in length. Other lengths can be used. The upper portion of the L-shaped structural member can be placed against the edge of a pallet 504. The lower portion of the L-shaped structural member sits on the deck of the pallet 504. Boxes 502 can be placed to sit on the lower portion of the L-shaped structural member. The tabs 516 can fit into gaps between the planks of the pallet 504. In this way, the tabs 516 can secure the L-shaped structural member in place longitudinally and laterally on the pallet 504. The plastic wrap 506 can secure the boxes 502 to the pallet 504. The lower end of the plastic wrap 506 can cover the upper portion of the L-shaped structural member to secure the load of boxes to the pallet 504. The upper portion of the L-shaped structural member provides the additional surface area for the plastic wrap 506. The blue arrows indicate the direction of tension the plastic wrap 506 places on the L-shaped structural member.

In a second embodiment, the apparatus 520 can be sized to fit the length of the long side of the pallet 504. In some embodiments, the long side of the pallet 503 is 48 inches in length. Other lengths can be used. The upper portion of the L-shaped structural member can be placed against the edge of a pallet 504. The lower portion of the L-shaped structural member sits on the deck of the pallet 504. Boxes 502 can be placed to sit on the lower portion of the L-shaped structural member. The tabs 522 can fit into gaps between the planks of the pallet 504. In this way, the tabs 516 can secure the L-shaped structural member in place longitudinally and laterally on the pallet 504. The plastic wrap 506 can secure the boxes 502 to the pallet 504. The lower end of the plastic wrap 506 can cover the upper portion of the L-shaped structural member to secure the load of boxes to the pallet 504. The upper portion of the L-shaped structural member provides the additional surface area for the plastic wrap 506. The blue arrows indicate the direction of tension the plastic wrap 506 places on the L-shaped structural member.

Figure 6A:
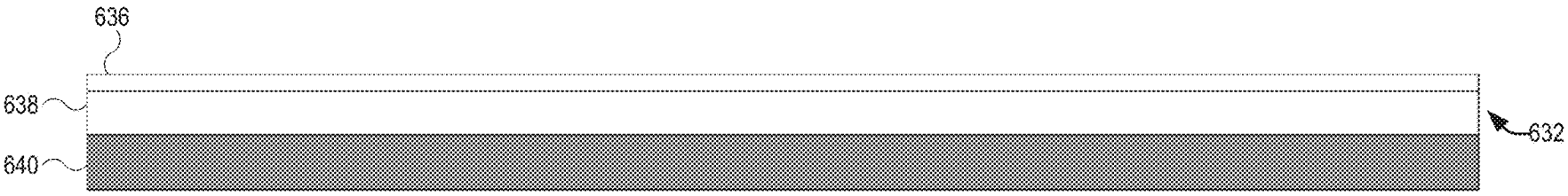
FIG. 6A illustrates a top view of the first apparatus to secure loads on a pallet.
Figure 6B:
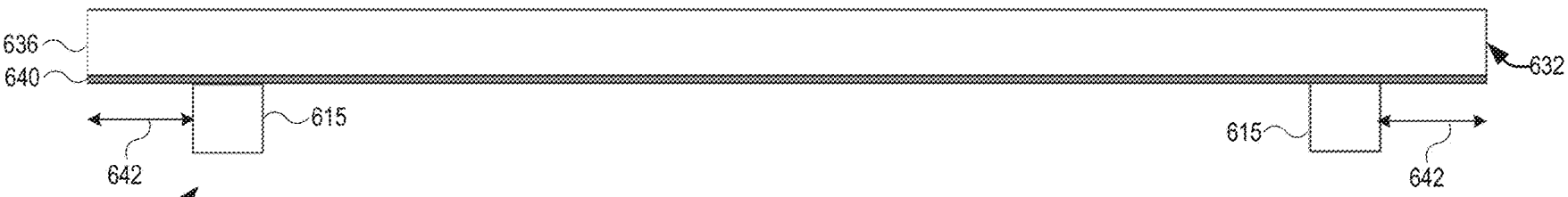
FIG. 6B illustrates a perspective front view of the L-shaped structural member.
Figure 6C:
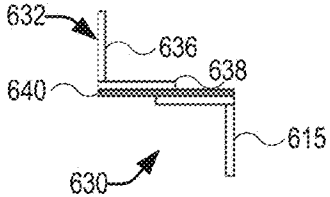
FIG. 6C illustrates a side profile view of the L-shaped structural member.

FIGS. 6A-C illustrate several views of a first embodiment of an apparatus to secure loads on a pallet. In a first embodiment, the first apparatus 630 can be used for the short side of a standard pallet. The first apparatus 630 can correspond to apparatus 414 as shown in FIG. 4. FIG. 6A illustrates a top-view of the first apparatus 630. The L-shaped structural member 632 can include an upper portion 636, a lower portion 638. The L-shaped structural member 632 can be constructed from corrugated cardboard. In various embodiments, the L-shaped structural member 632 can be constructed from plastic or formed from a plastic resin, metal, and other materials. The first embodiment 630 can be sized to fit a short side of a standard size pallet. The first embodiment 630 can be approximately 40 inches in length. In various embodiments the upper portion 636 and the lower portion 638 of the L-shaped structural member 632 can be formed from one material by forming an approximately 90-degree bend in the material. The upper portion 636 rises above the deck boards of the pallet.

In various embodiments, the L-shaped structural member 632 can be affixed to a horizontal member 640. In some embodiments, the horizontal member 640 can be a 1 inch by 4-inch deck board. In some embodiments, the horizontal member 640 can be constructed from one piece 3.5-inch×40 inch cardboard sheet. The lower portion 638 of the L-shaped structural member 632 can be affixed to a top side or a bottom side of the horizontal member 640 by use of an adhesive or any conventional means. The tabs 615 can be affixed to a bottom side or a top side of the horizontal member 640 by use of adhesive or any conventional means. In various embodiments, the L-shaped structural member 632 the horizontal member 640 can be formed as a single composite piece. In various embodiments, the horizontal member 640 and the tabs 615 can be formed as a single composite piece. In various embodiments, the L-shaped structural member 632, the horizontal member 640 and the tabs 615 can be formed as a single composite piece. The composite piece can be made from various materials such as cardboard, plastic, fiberglass, carbon fiber, metals, wood, etc.

In some embodiments, the upper portion 636 and the lower portion 638 can be formed from separate materials that can be joined together via any conventional means. The height of the upper portion 636 can be between ¼ inch and 12 inches. In some embodiments, the upper portion 636 can be 2 inches. The width of the lower portion 638 can be between ¼ inch and 12 inches. The width of the lower portion 638 can be 2 inches. In various embodiments, the L-shaped structural member can include a horizontal member 640. The lower portion 638 can be affixed to the horizontal member 640 via any conventional means. In various embodiments, the lower portion 638 and the horizontal member 640 can be constructed as a single piece.

FIG. 6B also illustrates a perspective front view of the L-shaped structural member 632 that includes an upper portion 636, a lower portion 638. In various embodiments, the L-shaped structural member 632 can be attached to a horizontal member 640. In various embodiments, the L-shaped structural member 632 and the horizontal member 640 can be constructed as a single piece. One or more tabs 615 can be attached to the L-shaped structural member 632. In various embodiments, the one or more tabs 615 can be affixed to the horizontal member 640. The tabs 615 extend into gaps in the deck boards of the pallet. The tabs 615 can be affixed from either or both ends of the L-shaped structural member 632 at distance 642 that corresponds to gaps between the deck planks for the pallet. In various embodiments, the distance 642 from the end of the pallet can be between 1 and 12 inches. In some embodiments, the distance 642 can be 1.5 inches.

In various embodiments the tabs 615 can be L-shaped. In various embodiments the tabs 615 can be formed from a single piece of material. The tabs 615 can be constructed from corrugated cardboard. The tabs 615 can be constructed from plastic or formed from a plastic resin, metal, or other materials.

FIG. 6C illustrates a side profile view of the L-shaped structural member 632. FIG. 6C shows the upper portion 636, the lower portion 638, the horizontal member 640, and a tab 615. In various embodiments, the upper portion 638, and the horizontal member 640 can be formed as a single composite piece. In various embodiments, the horizontal member 640 and the tabs 615 can be formed as a single composite piece. In various embodiments, the upper portion member 632, the horizontal member 640 and the tabs 615 can be formed as a single composite piece. The composite piece can be made from various materials such as cardboard, plastic, fiberglass, carbon fiber, metals, wood, etc.

Figure 7A:
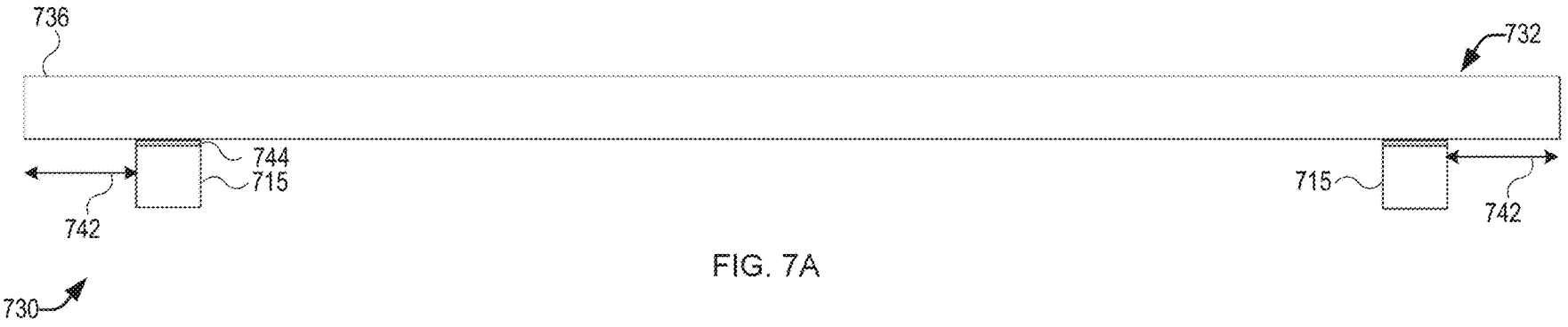
FIG. 7A illustrates a front view of the L-shaped structural member.
Figure 7B:
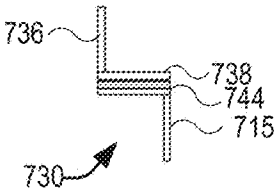
FIG. 7B illustrates a side view of the second apparatus.

FIGS. 7A-B illustrate several views of a second embodiment of an apparatus to secure loads on a pallet. In a second embodiment, the second apparatus 730 can be used for the long side of a standard size pallet. The second apparatus 730 can correspond to apparatus 420 as shown in FIG. 4. The second apparatus 730 can be sized to fit the length of the longer side of a standard sized pallet. In various embodiments, the second apparatus 730 can be 48 inches long.

FIG. 7A illustrates a front view of the L-shaped structural member 732. The L-shaped structural member 732 that includes an upper portion 736, a lower portion 738. One or more tabs 715 can be attached to the L-shaped structural member 732. In various embodiments, the one or more tabs 715 can be affixed to the lower portion 738 via adhesive 744, or fasteners. The one or more tabs can be affixed to oriented strand board (OSB) to provide height. The tabs 715 extend into gaps in the deck boards of the pallet. The tabs 715 can be affixed to either or both ends of the L-shaped structural member 732 at distance 742 that corresponds to gaps between the planks for the pallet. In various embodiments, the distance 742 from the end of the pallet can be between ¼ inch and 12 inches. In some embodiments, the distance 742 can be 3.5 inches.

FIG. 7B illustrates a side view of the second apparatus 730. In various embodiments the tabs 715 can be L-shaped. In various embodiments the tabs 715 can be formed from a single piece of material. The tabs 715 can be constructed from corrugated cardboard. The tabs 715 can be constructed from plastic or formed from a plastic resin metal, or other materials. In various embodiments, the upper portion 736, and the lower portion 738 can be formed as a single composite piece. In various embodiments, the lower portion 738 and the tabs 715 can be formed as a single composite piece. In various embodiments, the upper portion 736, the lower portion 738 and the tabs 715 can be formed as a single composite piece. The composite piece can be made from various materials such as cardboard, plastic, fiberglass, carbon fiber, metals, wood, etc.

Figure 8A:
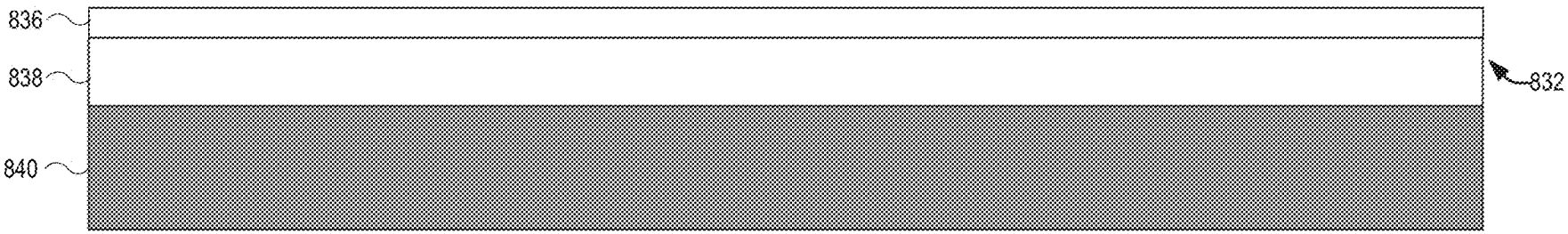
FIG. 8A illustrates a front view of the L-shaped structural member.
Figure 8B:
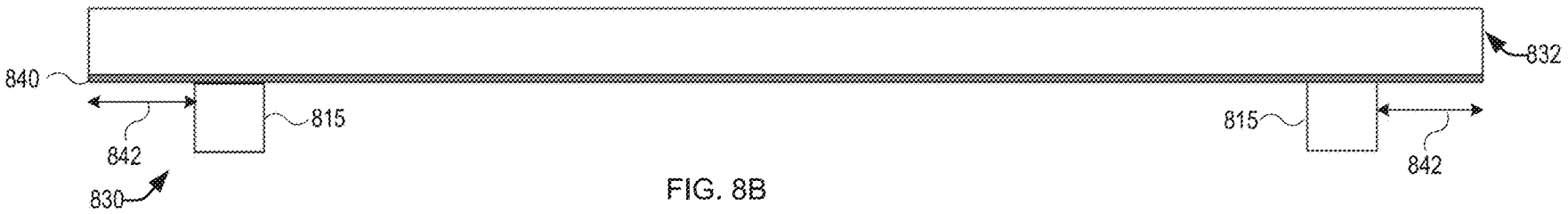
FIG. 8B illustrates a front view of the L-shaped structural member.
Figure 8C:
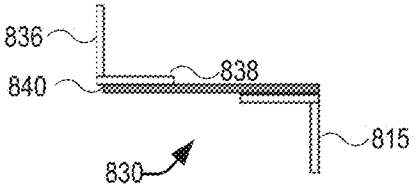
FIG. 8C illustrates a side profile view of the L-shaped structural member.

FIGS. 8A-C illustrate several views of a third embodiment of an apparatus to secure loads on a pallet. In a third embodiment, the third apparatus 830 can be used for the short side of a standard pallet. The third apparatus 830 can correspond to apparatus 414 as shown in FIG. 4. FIG. 8A illustrates a top-view of the third apparatus 830. The L-shaped structural member 832 can include an upper portion 836, a lower portion 838. The L-shaped structural member 832 can be constructed from corrugated cardboard. In various embodiments, the L-shaped structural member 832 can be constructed from plastic or formed from a plastic resin, metal, or other materials. The third embodiment 830 can be sized to fit a short side of a standard size pallet. The third embodiment 830 can be approximately 40 inches in length. In various embodiments the upper portion 836 and the lower portion 838 of the L-shaped structural member 832 can be formed from one material by forming an approximately 90-degree bend in the material. The upper portion 836 rises above the deck boards of the pallet.

In various embodiments, the L-shaped structural member 832 can be affixed to a horizontal member 840. In some embodiments, the horizontal member 840 can be a 1 by 6-inch deck board. In various embodiments, the horizontal member 840 can be constructed using a 5.5×40-inch cardboard sheet. The lower portion 838 of the L-shaped structural member 832 can be affixed to a top side of the horizontal member 840 by use of an adhesive or any conventional means. The tabs 815 can be affixed to a bottom side of the horizontal member 840 by use of adhesive or any conventional means.

In some embodiments, the upper portion 836 and the lower portion 838 can be formed from separate materials that can be joined together via any conventional means. The height of the upper portion 836 can be between ¼ inch and 12 inches. In some embodiments, the upper portion 836 can be 2 inches. The width of the lower portion 838 can be between ¼ inch and 12 inches. The width of the lower portion 838 can be 2 inches. In various embodiments, the L-shaped structural member can include a horizontal member 840. The lower portion 838 can be affixed to the horizontal member 840 via any conventional means. In various embodiments, the lower portion 838 and the horizontal member 840 can be formed as a single piece. In various embodiments, the upper portion 836, and the lower portion 838 can be formed as a single composite piece. In various embodiments, the horizontal portion 840 and the tabs 815 can be formed as a single composite piece. In various embodiments, the upper portion 836, the lower portion 838, the horizontal portion 840, and the tabs 815 can be formed as a single composite piece. The composite piece can be made from various materials such as cardboard, plastic, fiberglass, carbon fiber, metals, wood, etc.

FIG. 8B also illustrates a front view of the L-shaped structural member 832 that includes an upper portion 836, a lower portion 838. In various embodiments, the L-shaped structural member 832 can be attached to a horizontal member 840. One or more tabs 815 can be attached to the L-shaped structural member 832. In various embodiments, the one or more tabs 815 can be affixed to the horizontal member 840. The tabs 815 extend into gaps in the deck boards of the pallet. The tabs 815 can be affixed from either or both ends of the L-shaped structural member 832 at distance 842 that corresponds to gaps into the deck planks for the pallet. In various embodiments, the distance 842 from the end of the pallet can be between 1-12 inches. In some embodiments, the distance 842 can be 1.5 inches.

In various embodiments the tabs 815 can be L-shaped. In various embodiments the tabs 815 can be formed from a single piece of material. The tabs 815 can be constructed from corrugated cardboard. The tabs 815 can be constructed from plastic or formed from a plastic resin, metal, or other materials.

FIG. 8C illustrates a side profile view of the L-shaped structural member 832. FIG. 8C shows the upper portion 836, the lower portion 838, the horizontal member 840, and a tab 815.

Figure 9A:
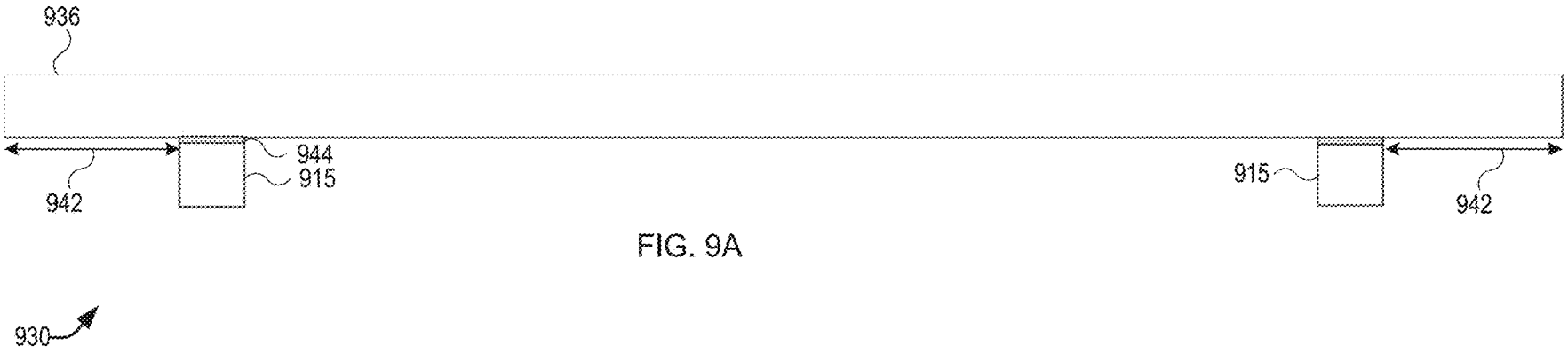
FIG. 9A illustrates a front view of the L-shaped structural member.
Figure 9B:
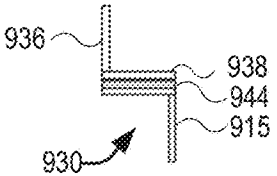
FIG. 9B illustrates a side view of the fourth apparatus.

FIGS. 9A-B illustrate several views of a fourth embodiment of an apparatus to secure loads on a pallet. In a fourth embodiment, the fourth apparatus 930 can be used for the long side of a standard size pallet. The fourth apparatus 930 can correspond to apparatus 420 as shown in FIG. 4. The fourth apparatus 930 can be sized to fit the length of the longer side of a standard sized pallet. In various embodiments, the fourth apparatus 930 can be 48 inches long.

FIG. 9A illustrates a front view of the L-shaped structural member 932. The L-shaped structural member 932 that includes an upper portion 936, a lower portion 938. One or more tabs 915 can be attached to the L-shaped structural member 932. In various embodiments, the one or more tabs 915 can be affixed to the lower portion 938 via adhesive 944 or fasteners. The one or more tabs 915 can be affixed to oriented strand board (OSB) to provide height. The tabs 915 extend into gaps in the deck boards of the pallet. The tabs 915 can be affixed from either or both ends of the L-shaped structural member 932 at distance 942 that corresponds to gaps between the deck planks for the pallet. In various embodiments, the distance 942 from the end of the pallet can be between 1 inch and 12 inches. In some embodiments, the distance 942 can be 5.5 inches. In various embodiments, the upper portion 936, and the lower portion 938 can be formed as a single composite piece. In various embodiments, the lower portion 938 and the tabs 915 can be formed as a single composite piece. In various embodiments, the upper portion 936, the lower portion 938, and the tabs 915 can be formed as a single composite piece. The composite piece can be made from various materials such as cardboard, plastic, fiberglass, carbon fiber, metals, wood, etc.

FIG. 9B illustrates a side view of the fourth apparatus 930. In various embodiments the tabs 915 can be L-shaped. In various embodiments the tabs 915 can be formed from a single piece of material. The tabs 915 can be constructed from corrugated cardboard. The tabs 915 can be constructed from plastic or formed from a plastic resin, metal, or other materials.

Figure 10:
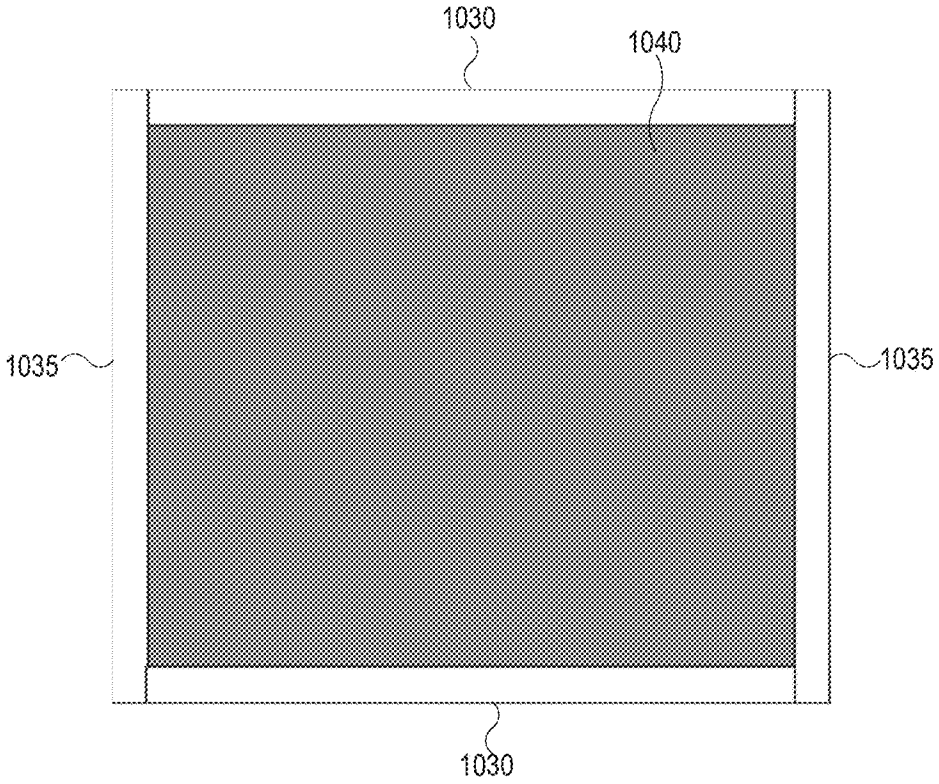
FIG. 10 illustrates a top view of a several embodiments of an apparatus used together to secure loads on a pallet.

FIG. 10 illustrates a top view of several embodiments of an apparatus used together to secure loads on a pallet. In various embodiments, one or two short apparatuses 1030, and/or one or two long apparatuses 1035 can be configured on a pallet. In some embodiments, a base portion 1040 can be used to connect the various short apparatuses 1030 and/or the various long apparatuses 1035 together. In various embodiments, the short apparatus 1030 and the long apparatus 1035 can include one or more notches to connect the short apparatus 1030 and the long apparatus 1035 together.

Figure 11:
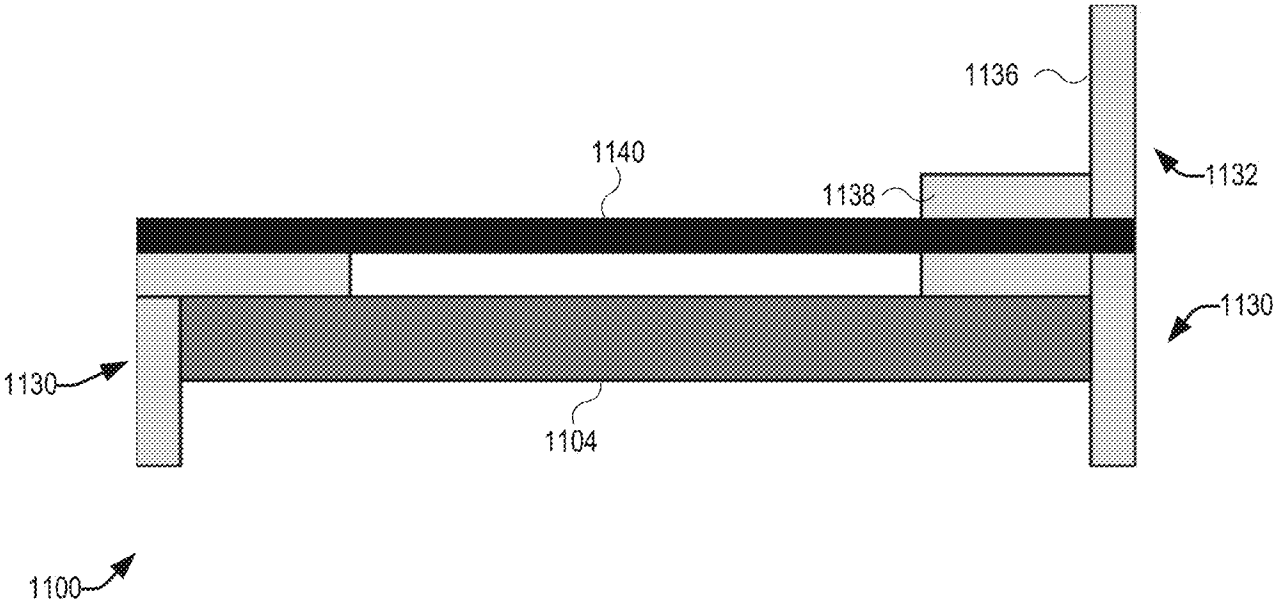
FIG. 11 illustrates a fifth embodiment of an apparatus used to secure loads on a pallet.

FIG. 11 illustrates a fifth embodiment of an apparatus used to secure loads on a pallet. FIG. 11 can be described as a twin bottom components design. At least one advantage of the twin bottom components design is to provide increased stability for securing loads on a pallet. FIG. 11 illustrates a side view of the fifth apparatus 1100 used to secure loads on a deck board. The fifth apparatus 1100 can include a single, upper L-shaped structural member 1132 affixed to an upper side of a horizontal member 1140 via adhesive or any conventional means. The horizontal member 1140 can be constructed of cardboard or similar materials. In the fifth apparatus 1100, two lower L-shaped structural members 1130 can be affixed to the lower side of the horizontal member 1140. The lower L-shaped structural members (or tabs) 1130 can be sized to fit along the outside edge of the deck board 1104. In various embodiments, the upper portion 1136, and the lower portion 1138 can be formed as a single composite piece. In various embodiments, the various embodiments, each lower L-shaped structural member 1130 can be formed as a single composite piece. In various embodiments, the upper portion 1136, the lower portion 1138, and the horizontal member 1140 can be formed as a single composite piece. In various embodiments, the upper portion 1136, the lower portion 1138, the horizontal member 1140 and the lower L-shaped structural members 1130 can be formed as a single composite piece. The composite piece can be made from various materials such as cardboard, plastic, fiberglass, carbon fiber, metals, wood, etc.

Figure 12:
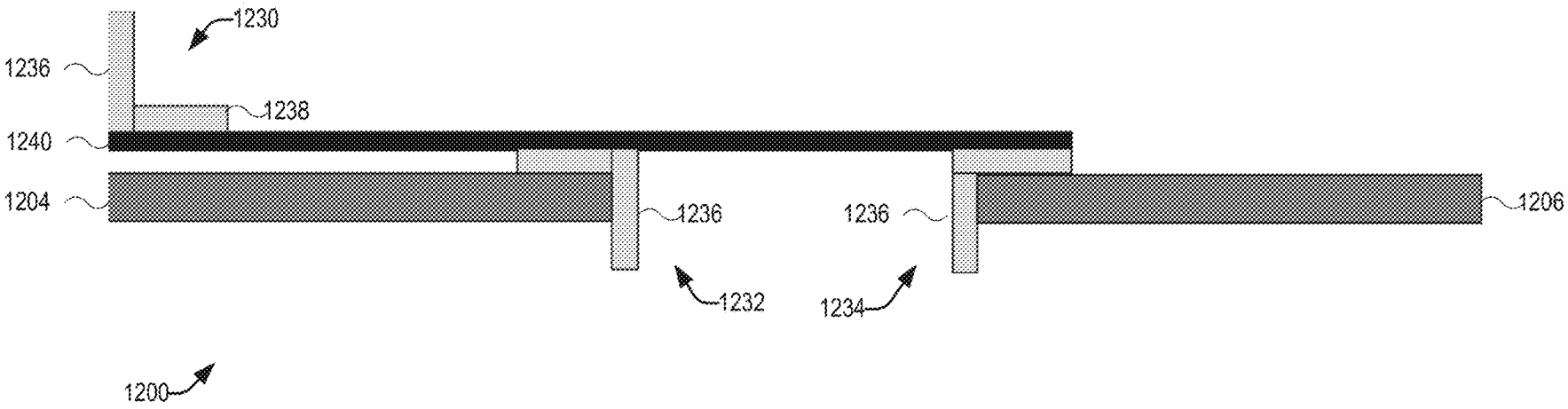
FIG. 12 illustrates a sixth embodiment of an apparatus used to secure loads on a pallet.

FIG. 12 illustrates a sixth embodiment of an apparatus used to secure loads on a pallet. The embodiment illustrated in FIG. 12 can be described as the twin bottom components inversed. FIG. 12 illustrates a side view of the sixth apparatus 1200 used to secure loads on a first deck board 1204 and a second deck board 1206. The sixth apparatus 1200 can include a single L-shaped structural member 1230 affixed to an upper side of a horizontal member 1240 via adhesive or any conventional means. The single L-shaped structural member 1232 can include an upper portion 1236 and a lower portion 1238. The horizontal member 1240 can be constructed of corrugated cardboard, wood, plastic, metal or other materials. The horizontal member 1240 can extend from a first deck board 1204 to a second deck board 1206. In this way, a first bottom L-shaped structural member 1232 can be arranged alongside a first inside edge of a first deck board 1204 and a second L-shaped structural member 1234 can be arranged alongside a second inside edge of a second deck board 1206. The two bottom L-shaped structural members 1232, 1234 are inversed from each other. The first and second bottom L-shaped structural members 1232, 1234 can be affixed to the bottom side of the horizontal member 1240 using adhesive or any conventional means. The upper portion 1236 of the lower, L-shaped structural members 1232, 1234 keep the load from shifting off the first deck board 1204 and the second deck board 1206. In various embodiments, the upper portion 1236, and the lower portion 1238 can be formed as a single composite piece. In various embodiments, the various embodiments, each lower L-shaped structural member 1236 can each be formed as a single composite piece. In various embodiments, the upper portion 1236, the lower portion 1238, and the horizontal member 1240 can be formed as a single composite piece. In various embodiments, the upper portion 1236, the lower portion 1238, the horizontal member 1240 and the lower L-shaped structural members 1236 can be formed as a single composite piece. The composite piece can be made from various materials such as cardboard, plastic, fiberglass, carbon fiber, metals, wood, etc.

Figure 13:
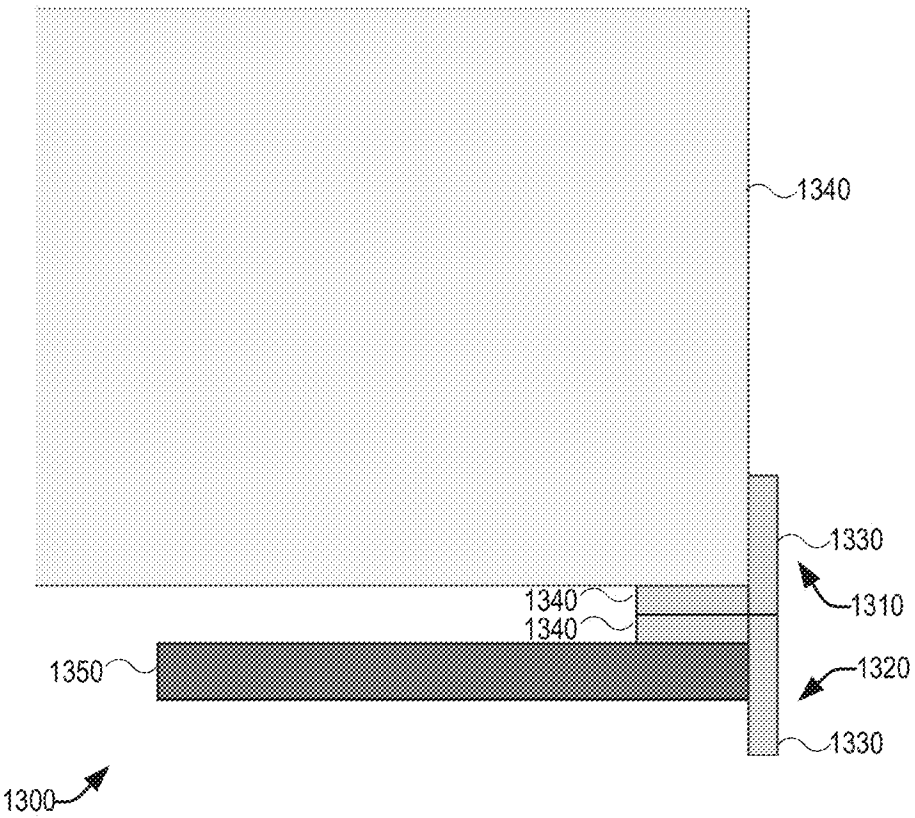
FIG. 13 illustrates a seventh embodiment of an apparatus to secure loads on a pallet.

FIG. 13 illustrates a seventh embodiment of an apparatus to secure loads on a pallet. The embodiment described in FIG. 13 can be described as the T-configuration. The seventh apparatus 1300 can include a first L-shaped structural member 1310 and a second L-shaped structural member 1320. Each of the two L-shaped structural member 1310, 1320 can include an upper portion 1330 and a lower portion 1340. The lower portions 1340 of the L-shaped structural members 1310, 1320 can be affixed together using an adhesive forming a T-shaped configuration. The L-shaped structural members (or tabs) 1310, 1320 can hold one or more boxes 1340 in place on the deck board 1350. In various embodiments, the upper portion 1330, and the lower portion 1340 can be formed as a single composite piece. Each of the two L-shaped structural member 1310, 1320 can include an upper portion 1330 and a lower portion 1340 which can be formed as a single composite member. The composite piece can be made from various materials such as cardboard, plastic, fiberglass, carbon fiber, metals, wood, etc.

Figure 14:
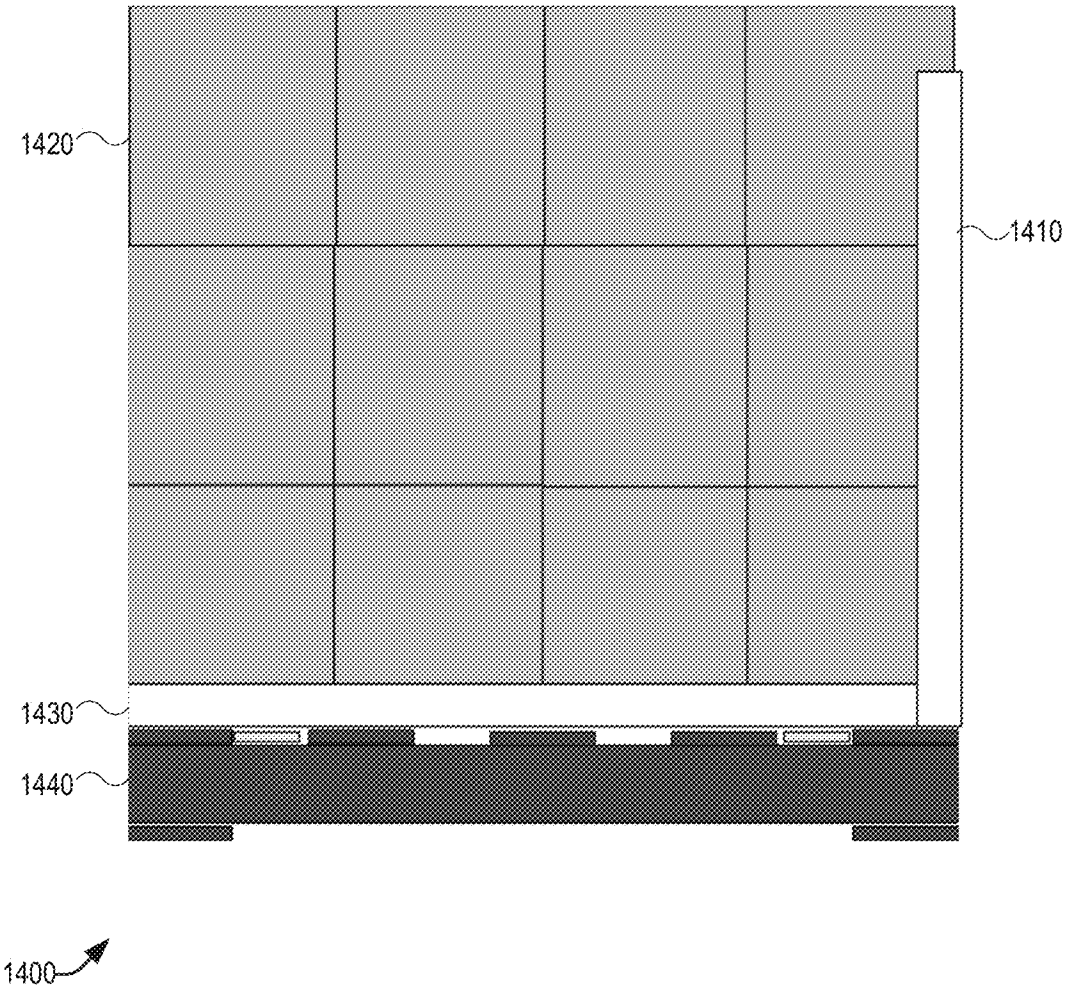
FIG. 14 illustrates an eighth embodiment of an apparatus to secure loads on a pallet.

FIG. 14 illustrates an eighth embodiment of an apparatus to secure loads on a pallet. The embodiment described in FIG. 14 improves vertical stability. In an eighth embodiment 1400, a vertical component 1410 can also be used to secure the load including one or more boxes 1420. The eighth embodiment 1400 can include one or more of the L-shaped structural members 1430. The vertical component 1410 can be placed at an edge of the load. In various embodiments, the vertical member 1410 can be placed at one, two, three or four of the corners. The vertical member 1410 can be secured to the load using plastic wrap (not shown). The vertical member 1410 can help keep the one or more boxes 1420 properly stacked on the pallet 1440. The vertical member 1410 can be L-shaped. The vertical member 1410 can be constructed from corrugated cardboard. In various embodiments, the vertical member 1410 can be constructed from plastic or formed from a plastic resin, metal, or other materials.

Figure 15:
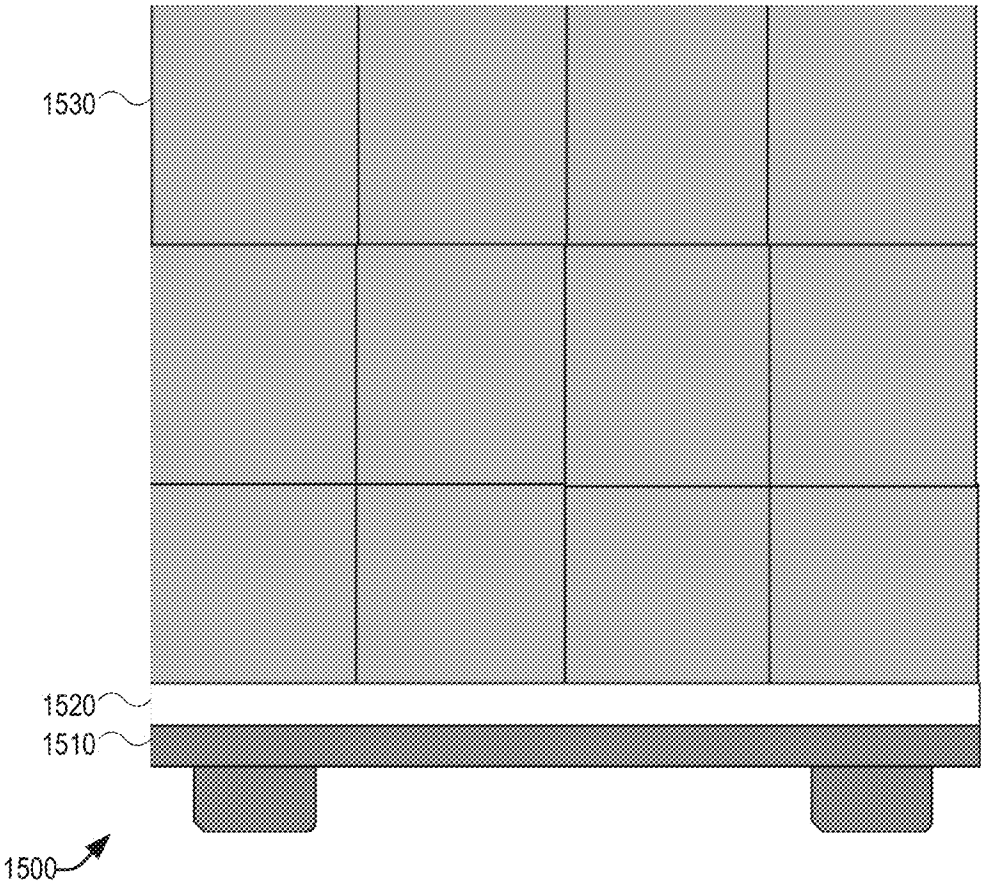
FIG. 15 illustrates an apparatus to secure loads on a cardboard pallet.

FIG. 15 illustrates an apparatus to secure loads on a cardboard pallet. In a ninth embodiment 1500 the pallet 1510 can be constructed from cardboard instead of wood or plastic. The pallet 1510 can include one or more L-shaped structural members 1520 affixed to the pallet 1510. The L-shaped structural members 1520 can be affixed to one or more of the sides of the surface of the cardboard pallet 1510. As the pallet 1510 is constructed from cardboard it can be easily recycled. The L-shaped structure member 1520 can secure the load of one or more boxes 1530 to the pallet 1510

Figure 16:
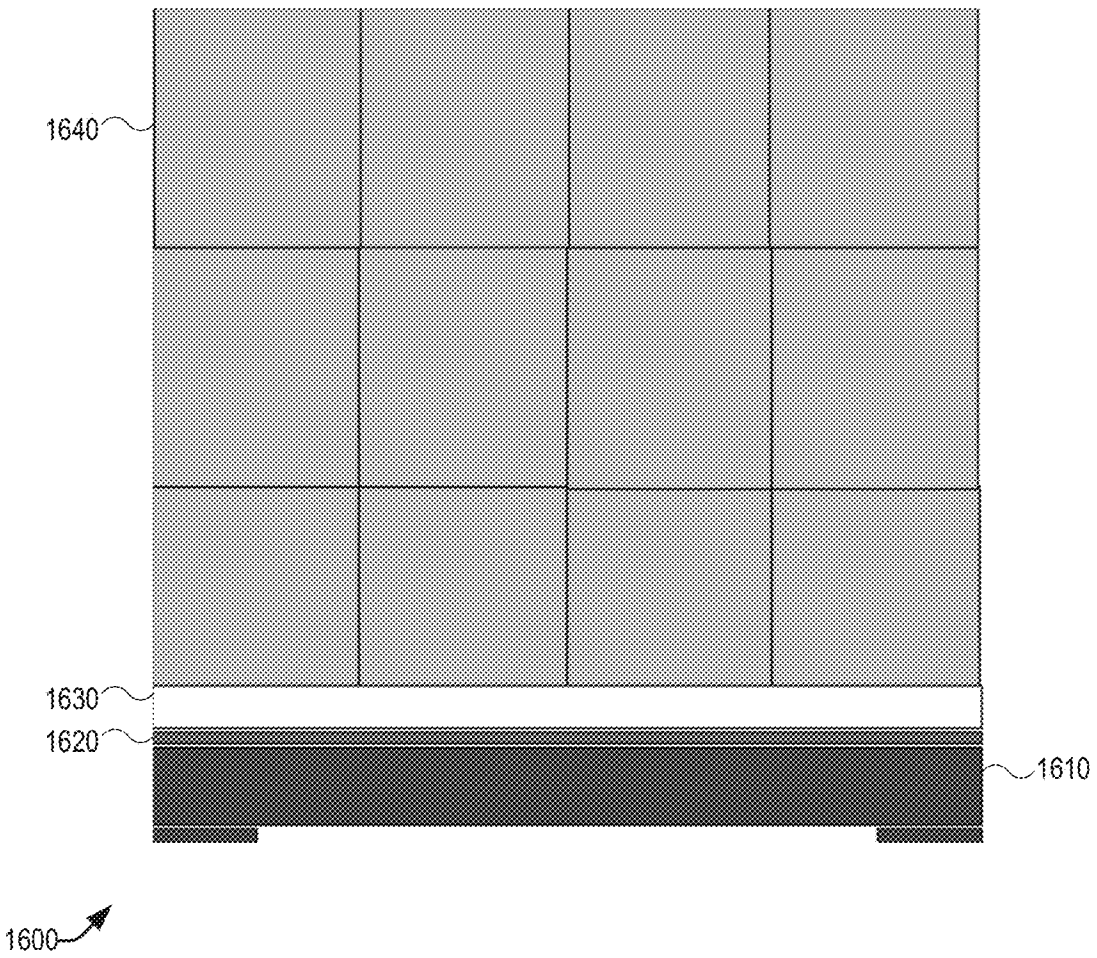
FIG. 16 illustrates an apparatus to secure loads on a flat pallet.

FIG. 16 illustrates an apparatus to secure loads on a flat pallet. In a tenth embodiment 1600 the pallet 1610 can be flat without the spaces between the deck planks. In various embodiments, a flat deck sheet 1620 can be placed over the pallet 1610. One or more L-shaped structural members 1630 can be used on top of the deck sheet. The L-shaped structural members 1630 can be used on one, two, three, or all four sides of the pallet 1610. In various embodiments, the one or more L-shaped structural members 1630 can be affixed to the deck sheet using adhesive or any conventional means. In various embodiments, the L-shaped structural member can be fastened to the pallet 1610 using one or more fasteners. The one or more L-shaped structural members 1630 can secure the one or more boxes 1640 of the load to the pallet 1610.

Figure 17:
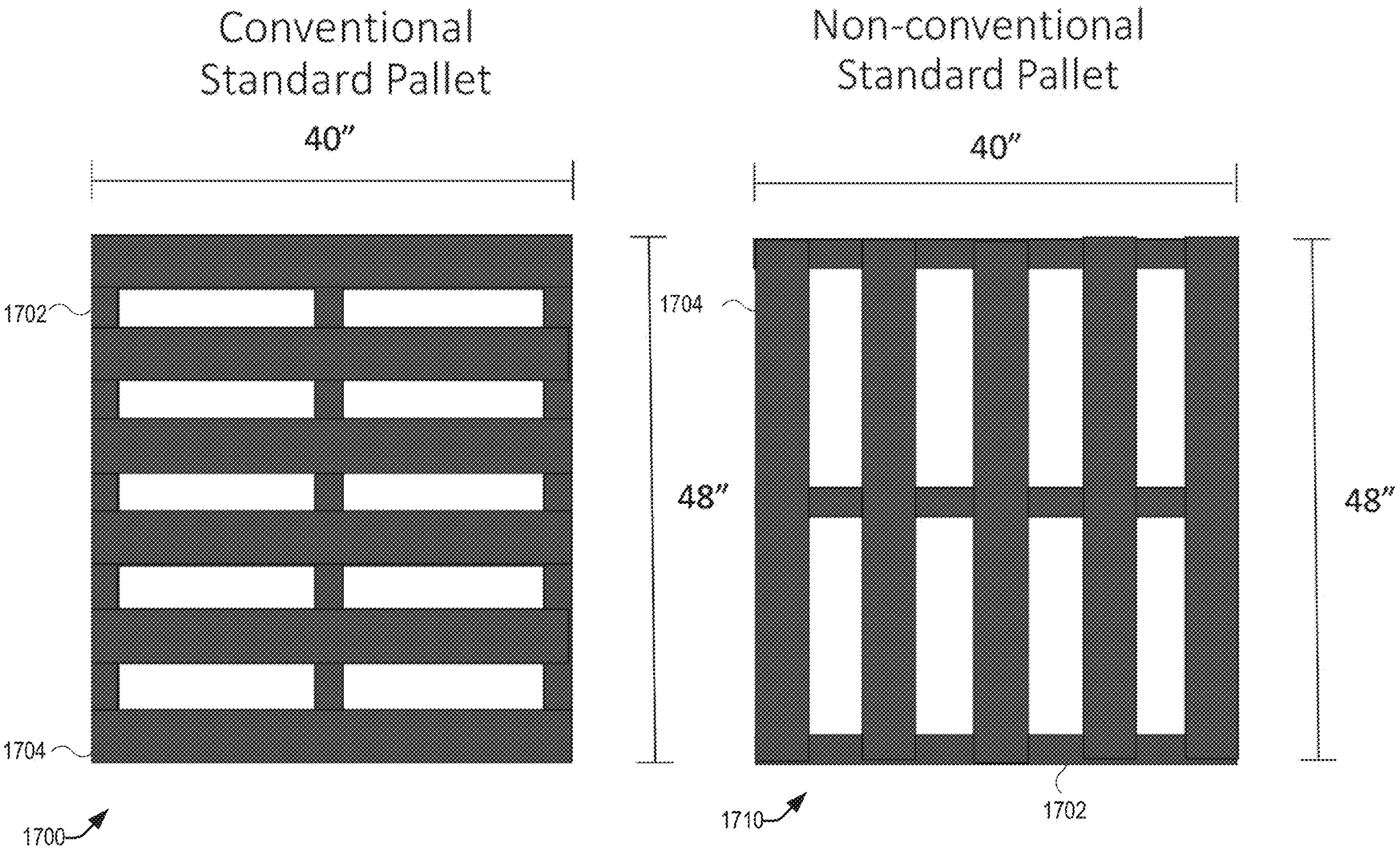
FIG. 17 illustrates a standard pallet and an alternate pallet configuration

FIG. 17 illustrates two different pallet configurations. In a standard pallet configuration 1700 the conventional standard pallet can include runners 1702 that run the length of a long side (e.g., 48-inch length side) and planks 1704 that run the length of a short side (e.g., 40-inch length side). In an alternate or non-conventional standard pallet configuration 1710, runners 1702 that run the length of a short side (e.g., 40-inch length side) and planks 1704 that run the length of a long side (e.g., 48-inch length side).

The apparatus disclosed herein can be referred to the way it is arranged on a pallet. For example on a conventional standard pallet, as shown in FIGS. 7 and 9, the apparatus can be used for the long side of the standard pallet configuration 1700 or the short side of the non-conventional pallet configuration 1710. On a conventional standard pallet FIGS. 6 and 8, the apparatus can be used for the short side of the standard pallet configuration 1700 or the long side of the non-conventional pallet configuration 1710. Other pallet sizes can be used as well.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of steps may be undertaken before, during, or after the above elements are considered.

Although the present disclosure has been described with respect to specific embodiments, it will be appreciated that the disclosure is intended to cover all modifications and equivalents within the scope of the following claims.

All patents, patent applications, publications, and descriptions mentioned herein are incorporated by reference in their entirety for all purposes. None is admitted to be prior art.

The specification and drawings are, accordingly, to be regarded in an illustrative rather than a restrictive sense. It will, however, be evident that various modifications and changes may be made thereunto without departing from the broader spirit and scope of the disclosure as set forth in the claims.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the disclosure to the specific form or forms disclosed, but on the contrary, the intention is to cover all modifications, alternative constructions and equivalents falling within the spirit and scope of the disclosure, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. The phrase "based on" should be understood to be open-ended, and not limiting in any way, and is intended to be interpreted or otherwise read as "based at least in part on," where appropriate. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of all examples, or exemplary language (e.g., "such as") provided herein, is intended merely to better illuminate embodiments of the disclosure and does not pose a limitation on the scope of the disclosure unless otherwise claimed. No language in the specification should be construed as indicating any non-claimed element as essential to the practice of the disclosure. The use of "or" is intended to mean an "inclusive or," and not an "exclusive or" unless specifically indicated to the contrary. Reference to a "first" component does not necessarily require that a second component be provided. Moreover, reference to a "first" or a "second" component does not limit the referenced component to a particular location unless expressly stated. The term "based on" is intended to mean "based at least in part on."

Disjunctive language such as the phrase "at least one of X, Y, or Z," unless specifically stated otherwise, is otherwise understood within the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present. Additionally, conjunctive language such as the phrase "at least one of X, Y, and Z," unless specifically stated otherwise, should also be understood to mean X, Y, Z, or any combination thereof, including "X, Y, and/or Z."

Preferred embodiments of this disclosure are described herein, including the best mode known to the inventors for carrying out the disclosure. Variations of those preferred embodiments may become apparent to those of ordinary skill in the art upon reading the foregoing description. The inventors expect skilled artisans to employ such variations as appropriate, and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. An apparatus, comprising:

a L-shaped structural member sized to run a length or a width of a pallet, the L-shaped structural member having a vertical extension and a base, the base having a top side and a bottom side, wherein the vertical extension extends upward from the top side of the base to engage with one or more boxes placed on the pallet; and a plurality of tabs formed as part of the bottom side of the L-shaped structural member, wherein the plurality of tabs formed on the bottom side of the base at positions along a length of the L-shaped structural member to fit within gaps between deck boards of the pallet.

2. The apparatus of claim 1, wherein a tab of the plurality of tabs has a width and a length, wherein the width is less than the width of a gap between the deck boards of the pallet and the length is greater than the width.

3. The apparatus of claim 1, wherein the L-shaped structural member is formed at least in part using oriented strand board.

4. The apparatus of claim 1, wherein the L-shaped structural member is formed at least in part from corrugated cardboard.

5. The apparatus of claim 1, wherein the L-shaped structure member is formed at least in part using a composite material.

6. The apparatus of claim 1, wherein the pallet has a short length side and a long length side, and wherein the L-shaped structural member is sized to fit the length of the short length side of the pallet.

7. The apparatus of claim 1, wherein the pallet has a short length side and a long length side, and wherein the L-shaped structural member is sized to fit the length of the long length side of the pallet.

8. A system for securing a plurality of boxes on a pallet having a long side and a short side, the system comprising:

a first L-shaped structural member sized to fit the long side of the pallet, the first L-shaped structural member having a vertical extension and a base, the base having a top side and a bottom side, wherein the vertical extension extends upward from the top side of the base to engage with one or more boxes placed on the pallet;

a second L-shaped structural member sized to fit the short side of the pallet; and a plurality of tabs formed as part of a bottom side of at least one of the first L-shaped structural member and the second L-shaped structural member, wherein the plurality of tabs are formed at positions to fit within gaps between deck boards of the pallet.

9. The system of claim 8, wherein at least one of the first L-shaped structural member and the second L-shaped structural member is formed at least in part using oriented strand board.

10. The system of claim 8, wherein at least one of the first L-shaped structural member and the second L-shaped structural member is formed at least in part from corrugated cardboard.

11. The system of claim 8, wherein at least one of the first L-shaped structural member and the second L-shaped structural member is formed at least in part using a composite material.

12. The system of claim 8, further comprising:

a third L-shaped structural member sized to fit the short side of the pallet; and a second plurality of tabs affixed to a bottom side of the third L-shaped structural member, wherein the plurality of tabs are affixed at positions to fit within gaps between deck boards of the pallet.

13. The system of claim 12, further comprising:

a fourth L-shaped structural member sized to fit the long side of the pallet; and a third plurality of tabs affixed to the bottom side of the fourth L-shaped structural member, wherein the plurality of tabs are affixed at positions to fit within gaps between deck boards of the pallet.

14. The system of claim 12, further comprising:

a fourth L-shaped structural member sized to fit the long side of the pallet; and a third plurality of tabs affixed to the bottom side of a third L-shaped structural member, wherein the plurality of tabs are affixed at positions to fit within gaps between deck boards of the pallet.

15. The system of claim 8, further comprising a vertical L-shaped structural member, wherein the vertical L-shaped structural member is sized to a height of boxes stacked on the pallet.

16. The system of claim 8, further comprising a base component sized to fit a length and a width of the pallet.

17. The system of claim 16, wherein the base component is constructed from corrugated cardboard.

18. The system of claim 16, wherein the base component is constructed from plywood.

19. An apparatus for securing loads on a pallet, comprising:

a composite L-shaped structural member sized to run a length or a width of a pallet, the composite L-shaped structural member having a vertical extension and a base, the base having a top side and a bottom side, wherein the vertical extension extends upward from the top side of the base to engage with one or more boxes placed on the pallet; and a plurality of tabs formed as part of the bottom side of the composite L-shaped structural member, wherein the plurality of tabs formed on the bottom side of the base at positions along a length of the composite L-shaped structural member to fit within gaps between deck boards of the pallet.

20. The apparatus of claim 19, wherein a tab of the plurality of tabs has a width and a length, wherein the width is less than the width of a gap between the deck boards of the pallet and the length is greater than the width.

* * * * *